US006453666B1

(12) United States Patent
Surnilla et al.

(10) Patent No.: US 6,453,666 B1
(45) Date of Patent: Sep. 24, 2002

(54) METHOD AND SYSTEM FOR REDUCING VEHICLE TAILPIPE EMISSIONS WHEN OPERATING LEAN

(75) Inventors: Gopichandra Surnilla, West Bloomfield, MI (US); Jeffrey Scott Hepburn, Birmingham, MI (US); Jerry D. Robichaux, Tucson, AZ (US); Michael John Cullen, Northville, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/884,241

(22) Filed: Jun. 19, 2001

(51) Int. Cl.[7] ..... F01N 3/00

(52) U.S. Cl. ..... 60/285; 60/274; 60/295; 60/297

(58) Field of Search ..... 60/274, 285, 277, 60/295, 297

(56) References Cited

U.S. PATENT DOCUMENTS

| | | | |
|---|---|---|---|
| 3,696,618 | A | 10/1972 | Boyd et al. |
| 3,969,932 | A | 7/1976 | Rieger et al. |
| 4,033,122 | A | 7/1977 | Masaki et al. |
| 4,036,014 | A | 7/1977 | Ariga |
| 4,167,924 | A | 9/1979 | Carlson et al. |
| 4,178,883 | A | 12/1979 | Herth |
| 4,186,296 | A | 1/1980 | Crump, Jr. |
| 4,251,989 | A | 2/1981 | Norimatsu et al. |
| 4,533,900 | A | 8/1985 | Muhlberger et al. |
| 4,622,809 | A | 11/1986 | Abthoff et al. |
| 4,677,955 | A | 7/1987 | Takao |
| 4,854,123 | A | 8/1989 | Inoue et al. |
| 4,884,066 | A | 11/1989 | Miyata et al. |
| 4,913,122 | A | 4/1990 | Uchida et al. |
| 4,964,272 | A | 10/1990 | Kayanuma |

(List continued on next page.)

FOREIGN PATENT DOCUMENTS

| | | |
|---|---|---|
| DE | 196 07 151 C1 | 7/1997 |
| EP | 0 351 197 A2 | 1/1990 |
| EP | 0 444 783 A1 | 9/1991 |
| EP | 0 503 882 A1 | 9/1992 |
| EP | 0 508 389 A1 | 1/1994 |

(List continued on next page.)

OTHER PUBLICATIONS

C. D. De Boer et al., "Engineered Control Strategies for Improved Catalytic Control of $NO_x$ in Lean Burn Applications," SAE Technical Paper No. 881595, Oct. 10–13, 1988.

(List continued on next page.)

*Primary Examiner*—Thomas Denion
*Assistant Examiner*—Binh Tran
(74) *Attorney, Agent, or Firm*—Allan J. Lippa

(57) ABSTRACT

A method and system for operating a lean-burn internal combustion engine in cooperation with an exhaust gas purification system having an emission control device, wherein the system includes a controller which calculates current levels of a selected exhaust gas constituent, such as $NO_x$, during lean engine operating conditions based upon the difference between a determined instantaneous feedgas $NO_x$ concentration and a determined instantaneous device efficiency. The controller discontinues lean engine operation when the tailpipe $NO_x$, expressed in terms of either grams-per-mile or grams-per-hour, exceeds a predetermined threshold level, either instantaneously or as averaged over the course of a device purge-fill cycle.

12 Claims, 1 Drawing Sheet

U.S. PATENT DOCUMENTS 5,009,210 A 4/1991 Nakagawa et al.
5,088,281 A 2/1992 Izutani et al.
5,097,700 A 3/1992 Nakane
5,165,230 A 11/1992 Kayanuma et al.
5,174,111 A 12/1992 Nomura et al.
5,189,876 A 3/1993 Hirota et al.
5,201,802 A 4/1993 Hirota et al.
5,209,061 A 5/1993 Takeshima
5,222,471 A 6/1993 Stueven
5,233,830 A 8/1993 Takeshima et al.
5,267,439 A 12/1993 Raff et al.
5,270,024 A 12/1993 Kasahara et al.
5,272,871 A 12/1993 Oshima et al.
5,325,664 A 7/1994 Seki et al.
5,331,809 A 7/1994 Takeshima et al.
5,335,538 A 8/1994 Blischke et al.
5,357,750 A 10/1994 Ito et al.
5,359,852 A 11/1994 Curran et al.
5,377,484 A 1/1995 Shimizu
5,402,641 A 4/1995 Katoh et al.
5,410,873 A 5/1995 Tashiro
5,412,945 A 5/1995 Katoh et al.
5,412,946 A 5/1995 Oshima et al.
5,414,994 A 5/1995 Cullen et al.
5,419,122 A 5/1995 Tabe et al.
5,423,181 A 6/1995 Katoh et al.
5,426,934 A 6/1995 Hunt et al.
5,433,074 A 7/1995 Seto et al.
5,437,153 A 8/1995 Takeshima et al.
5,448,886 A 9/1995 Toyoda
5,448,887 A 9/1995 Takeshima
5,450,722 A 9/1995 Takeshima et al.
5,452,576 A 9/1995 Hamburg et al.
5,472,673 A 12/1995 Goto et al.
5,473,887 A 12/1995 Takeshima et al.
5,473,890 A 12/1995 Takeshima et al.
5,483,795 A 1/1996 Katoh et al.
5,531,972 A 7/1996 Rudy
5,544,482 A 8/1996 Matsumoto et al.
5,551,231 A 9/1996 Tanaka et al.
5,554,269 A 9/1996 Joseph et al.
5,569,848 A 10/1996 Sharp
5,577,382 A 11/1996 Kihara et al.
5,595,060 A 1/1997 Togai et al.
5,598,703 A 2/1997 Hamburg et al.
5,617,722 A 4/1997 Takaku
5,622,047 A 4/1997 Yamashita et al.
5,626,014 A 5/1997 Hepburn et al.
5,626,117 A 5/1997 Wright et al.
5,655,363 A 8/1997 Ito et al.
5,657,625 A 8/1997 Koga et al.
5,693,877 A 12/1997 Ohsuga et al.
5,713,199 A 2/1998 Takeshima et al.
5,715,679 A 2/1998 Asanuma et al.
5,722,236 A 3/1998 Cullen et al.
5,724,808 A 3/1998 Ito et al.
5,729,971 A 3/1998 Matsuno et al.
5,732,554 A 3/1998 Sasaki et al.
5,735,119 A 4/1998 Asanuma et al.
5,737,917 A 4/1998 Nagai
5,740,669 A 4/1998 Kinugasa et al.
5,743,084 A 4/1998 Hepburn
5,743,086 A 4/1998 Nagai
5,746,049 A 5/1998 Cullen et al.
5,746,052 A 5/1998 Kinugasa et al.
5,752,492 A 5/1998 Kato et al.
5,771,685 A 6/1998 Hepburn
5,771,686 A 6/1998 Pischinger et al.
5,778,666 A 7/1998 Cullen et al.
5,792,436 A 8/1998 Feeley et al.
5,802,843 A 9/1998 Kurihara et al.
5,803,048 A 9/1998 Yano et al.
5,806,306 A 9/1998 Okamoto et al.
5,813,387 A 9/1998 Minowa et al.
5,831,267 A 11/1998 Jack et al.
5,832,722 A 11/1998 Cullen et al.
5,842,339 A 12/1998 Bush et al.
5,842,340 A 12/1998 Bush et al.
5,862,661 A 1/1999 Zhang et al.
5,865,027 A 2/1999 Hanafusa et al.
5,867,983 A 2/1999 Otani
5,877,413 A 3/1999 Hamburg et al.
5,887,421 A * 3/1999 Misutani ..... 60/274
5,894,725 A * 4/1999 Cullen et al. ..... 60/274
5,910,096 A 6/1999 Hepburn et al.
5,929,320 A 7/1999 Yoo
5,934,072 A 8/1999 Hirota et al.
5,938,715 A 8/1999 Zhang et al.
5,953,907 A 9/1999 Kato et al.
5,966,930 A 10/1999 Hatano et al.
5,970,707 A 10/1999 Sawada et al.
5,974,788 A 11/1999 Hepburn et al.
5,974,791 A 11/1999 Hirota et al.
5,974,793 A 11/1999 Kinugasa et al.
5,974,794 A 11/1999 Gotoh et al.
5,979,161 A 11/1999 Hanafusa et al.
5,979,404 A 11/1999 Minowa et al.
5,983,627 A 11/1999 Asik
5,992,142 A 11/1999 Pott
5,996,338 A 12/1999 Hirota
6,003,308 A 12/1999 Tsutsumi et al.
6,012,282 A 1/2000 Kato et al.
6,012,428 A 1/2000 Yano et al.
6,014,859 A 1/2000 Yoshizaki et al.
6,023,929 A 2/2000 Ma
6,026,640 A 2/2000 Kato et al.
6,058,700 A 5/2000 Yamashita et al.
6,073,440 A 6/2000 Douta et al.
6,079,204 A 6/2000 Sun et al.
6,092,021 A 7/2000 Ehlbeck et al.
6,092,369 A 7/2000 Hosogai et al.
6,101,809 A 8/2000 Ishuzuka et al.
6,102,019 A 8/2000 Brooks
6,105,365 A 8/2000 Deeba et al.
6,119,449 A 9/2000 Köhler
6,128,899 A 10/2000 Oono et al.
6,134,883 A 10/2000 Kato et al.
6,138,453 A 10/2000 Sawada et al.
6,145,302 A 11/2000 Zhang et al.
6,145,305 A 11/2000 Itou et al.
6,148,611 A 11/2000 Sato
6,148,612 A 11/2000 Yamashita et al.
6,161,378 A 12/2000 Hanaoka et al.
6,161,428 A 12/2000 Esteghlal et al.
6,164,064 A 12/2000 Pott
6,189,523 B1 2/2001 Weisbrod et al.
6,199,373 B1 3/2001 Hepburn et al.
6,202,406 B1 3/2001 Griffin et al.
6,205,773 B1 3/2001 Suzuki
6,214,207 B1 4/2001 Miyata et al.
6,216,448 B1 4/2001 Schnaibel et al.
6,216,451 B1 4/2001 Schnaibel et al.
6,233,923 B1 5/2001 Itou et al.
6,237,330 B1 5/2001 Takahashi et al.
6,244,046 B1 6/2001 Yamashita
6,343,466 B1 * 2/2002 Mukaihira et al. ..... 60/277
6,383,267 B1 * 5/2002 Takaku et al. ..... 96/111

FOREIGN PATENT DOCUMENTS

JP 62-97630 5/1987
JP 62-117620 5/1987

| | | |
|---|---|---|
| JP | 64-53042 | 3/1989 |
| JP | 2-30915 | 2/1990 |
| JP | 2-33408 | 2/1990 |
| JP | 2-207159 | 8/1990 |
| JP | 3-135147 | 6/1991 |
| JP | 5-26080 | 2/1993 |
| JP | 5-106493 | 4/1993 |
| JP | 5-106494 | 4/1993 |
| JP | 6-58139 | 3/1994 |
| JP | 6-264787 | 9/1994 |
| JP | 7-97941 | 4/1995 |

OTHER PUBLICATIONS

Y. Kaneko et al., "Effect of Air–Fuel Ratio Modulation on Conversion Efficiency of Three–Way Catalysts," SAE Technical Paper No. 780607, Jun. 5–9, 1978, pp. 119–127.

W. H. Holl, "Air–Fuel Control to Reduce Emissions I. Engine–Emissions Relationships," SAE Technical Paper No. 800051, Feb. 25–29, 1980.

A. H. Meitzler, "Application of Exhaust–Gas–Oxygen Sensors to the Study of Storage Effects in Automative Three–Way Catalysts," SAE Technical Paper No. 800019, Feb. 25–29, 1980.

J. Theis et al., "An Air/Fuel Algorithm to Improve the $NO_x$ Conversion of Copper–Based Catalysts," SAE Technical Paper No. 922251, Oct. 19–22, 1992.

W. Wang, "Air–Fuel Control to Reduce Emissions, II. Engine–Catalyst Characterization Under Cyclic Conditions," SAE Technical Paper No. 800052, Feb. 25–29, 1980.

T. Yamamoto et al., "Dynamic Behavior Analysis of Three Way Catalytic Reaction," JSAE 882072–882166.

* cited by examiner

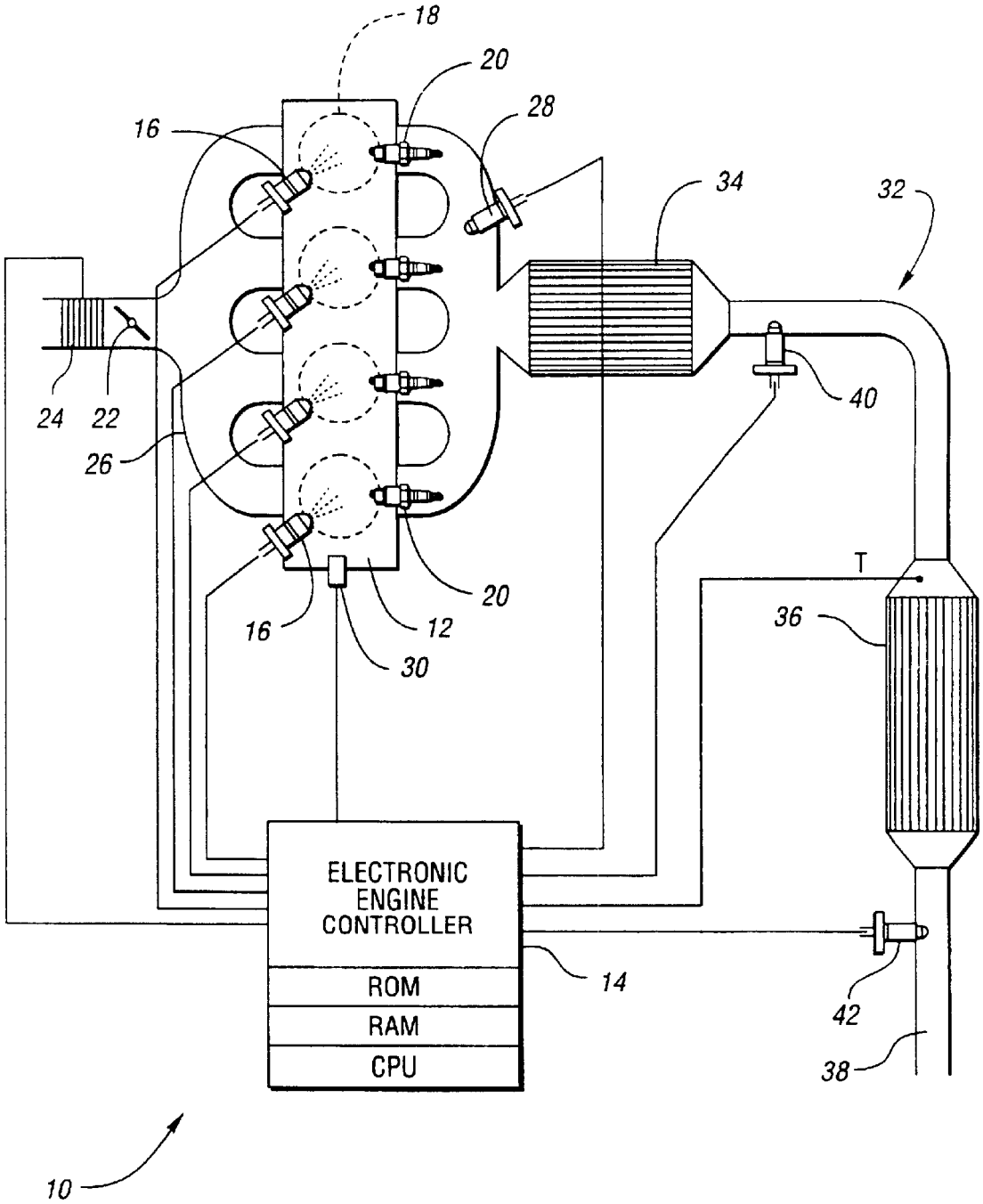
18
20
28
16
34
32
24
22
26
40
T
36
20
16
12
30
ELECTRONIC
ENGINE
CONTROLLER
ROM
RAM
CPU
14
42
38
10

METHOD AND SYSTEM FOR REDUCING VEHICLE TAILPIPE EMISSIONS WHEN OPERATING LEAN

BACKGROUND OF THE INVENTION

1. Field of the Invention

The invention relates to methods and systems for controlling the operation of "lean-burn" internal combustion engines used in motor vehicles to obtain improvements in vehicle fuel economy.

2. Background Art

The exhaust gas generated by a typical internal combustion engine, as may be found in motor vehicles, includes a variety of constituents, including hydrocarbons (HC), carbon monoxide (CO), and nitrogen oxides ($NO_x$). The respective rates at which an engine generates these constituents are typically dependent upon a variety of factors, including such operating parameters as air-fuel ratio ($\lambda$), engine speed and load, engine temperature, ambient humidity, ignition timing ("spark"), and percentage exhaust gas recirculation ("EGR"). The prior art often maps values for various of these "feedgas" constituents based, for example, on detected values for instantaneous engine speed and engine load.

In order to comply with modern restrictions regarding permissible levels of selected exhaust gas constituents, vehicle exhaust treatment systems often employ one or more three-way catalysts, referred to as an emission control device, disposed in an exhaust passage to store and release selected exhaust gas constituents, depending upon engine operating conditions. For example, U.S. Pat. No. 5,437,153 teaches an emission control device which stores exhaust gas $NO_x$ when the exhaust gas is lean, and releases previously-stored $NO_x$ when the exhaust gas is either stoichiometric or "rich" of stoichiometric, i.e., when the ratio of intake air to injected fuel is at or below the stoichiometric air-fuel ratio. Significantly, a device's actual capacity to store a selected constituent gas, such as $NO_x$, is often finite and, hence, in order to maintain low tailpipe $NO_x$ emissions, the device must be periodically cleansed or "purged" of stored $NO_x$. The frequency or timing of each purge event must be controlled so that the device does not otherwise reach its actual $NO_x$ storage capacity, because engine-generated $NO_x$ would thereafter pass through the device and effect an increase in tailpipe $NO_x$ emissions. Further, the timing of each purge event is preferably controlled to avoid the purging of only partially-filled devices, due to the fuel penalty associated with the purge event's enriched air-fuel mixture and, particularly, the fuel penalty associated with the release of oxygen previously stored in any other upstream emission control device.

In response, U.S. Pat. No. 5,473,887 and U.S. Pat. No. 5,437,153 teach use of $NO_x$-estimating means which seeks to estimate the cumulative amount of $NO_x$ which has been generated by the engine and, presumptively, has been stored in the device during a given lean operating condition. The incremental amount of $NO_x$ believed to have been generated and stored in the device is obtained from a lookup table based on engine speed, or on engine speed and load (the latter perhaps itself inferred, e.g., from intake manifold pressure). However, the disclosed $NO_x$-estimating means fails to account for any instantaneous reduction in device efficiency, i.e., the device's ability to store an additional amount of feedgas $NO_x$. The disclosed $NO_x$-estimating means further fails to account for the device's initial storage of oxygen which likewise reduces the device's overall $NO_x$-storing capacity.

The prior art has also recognized that the device's actual or maximum capacity to store selected exhaust gas constituents is often function of many variables, including device temperature, device history, sulfation level, and thermal damage, i.e., the extent of damage to the device's constituent-storing materials due to excessive heat. See, e.g., U.S. Pat. No. 5,437,153, which further teaches that, as the device approaches its maximum capacity, the incremental rate at which the device stores $NO_x$ may begin to fall. Accordingly, U.S. Pat. No. 5,437,153 teaches use of a nominal $NO_x$ capacity which is significantly less than the actual $NO_x$ capacity of the device, to thereby theoretically provide the device with a perfect instantaneous $NO_x$-storing efficiency, i.e., the device stores all engine-generated $NO_x$, as long as stored $NO_x$ remains below the nominal capacity. A purge event is scheduled to rejuvenate the device whenever accumulated estimates of engine-generated $NO_x$ reach the nominal device capacity. Unfortunately, however, the use of such a fixed nominal $NO_x$ capacity necessarily requires a larger device, because this prior art approach relies upon a partial, e.g., fifty-percent $NO_x$ fill in order to ensure retention of engine-generated $NO_x$.

When the engine is operated using a fuel containing sulfur, $SO_x$ accumulates in the device to cause a decrease in both the device's absolute capacity to store the selected exhaust gas constituent(s) and the device's instantaneous efficiency. When such device sulfation exceeds a critical level, the accumulated $SO_x$ must be "burned off" or released during a desulfation event, during which device temperatures are raised above perhaps about 650° C. in the presence of excess HC and CO. By way of example only, U.S. Pat. No. 5,746,049 teaches a device desulfation method which includes raising the device temperature to at least 650° C. by introducing a source of secondary air into the exhaust upstream of the $NO_x$ device when operating the engine with an enriched air-fuel mixture and relying on the resulting exothermic reaction to raise the device temperature to the desired level to purge the device of stored $SO_x$.

Therefore, the inventors herein have recognized a need for a method and system for controlling the filling and purging of an emission control device with a selected exhaust gas constituent which can more accurately regulate overall tailpipe emissions of the exhaust gas constituent than prior art methods and systems.

SUMMARY OF THE INVENTION

In accordance with the invention, a method is provided for controlling the operation of a lean-burn internal combustion engine, the exhaust gas from which is directed through an exhaust treatment system including an emission control device that stores an exhaust gas constituent during lean engine operation and releases previously-stored exhaust gas constituent during engine operation at or rich of stoichiometry. Under the invention, during lean engine operation, the method includes determining a value representing an incremental amount, in grams per second, of a selected exhaust gas constituent, such as $NO_x$, present in the engine feedgas as a function of current values for engine speed, engine load or torque, and the lean operating condition's air-fuel ratio. The method also includes determining a value representing the incremental amount of the exhaust gas constituent (e.g, $NO_x$) being instantaneously stored in the device, preferably, as a function of device temperature, the amount of the constituent that is already stored in the device, an amount of sulfur which has accumulated within the device, and a value representing device aging (the latter being caused by a permanent thermal aging of the device or the diffusion of sulfur into the core of the device material which cannot be purged).

The method further includes calculating a value representing instantaneous tailpipe emissions of the exhaust gas constituent (e.g., $NO_x$) based on the difference between the feedgas value and the incremental constituent-storage value; comparing the instantaneous tailpipe constituent emissions value to a predetermined threshold value; and discontinuing the lean engine operating condition when the instantaneous tailpipe constituent emissions value exceeds the predetermined threshold level, either instantaneously or as averaged over the course of a device purge-fill cycle, whose duration is determined by a timer which is nominally reset to zero upon commencement of an immediately prior rich engine operating condition.

In accordance with another feature of the invention, in a preferred embodiment, the method further includes generating a value representative of the cumulative number of miles that the vehicle has traveled during a given device purge-fill cycle; and determining a value representing average tailpipe constituent emissions in grams per mile using the instantaneous tailpipe constituent emissions value and the accumulated mileage value.

In accordance with another feature of the invention, an exemplary method further includes determining a need for releasing previously-stored exhaust gas constituent from the device; and deselecting the device-filling lean engine operation in response to the determined need. More specifically, under the invention, determining the need for releasing previously-stored exhaust gas constituent includes calculating a value representing the cumulative amount of the constituent that has been stored in the device during a given lean operation condition, based on the incremental constituent-storage value; determining a value representing an instantaneous constituent-storage capacity for the device; and comparing the cumulative constituent-storage value to the instantaneous constituent-storage capacity value. In a preferred embodiment, the step of determining the instantaneous constituent-storage capacity value includes estimating an amount of sulfur which has accumulated within the device.

Other objects, features and advantages of the present invention are readily apparent from the following detailed description of the best mode for carrying out the invention when taken in connection with the accompanying drawings.

BRIEF DESCRIPTION OF THE DRAWING

The Drawing is a schematic of an exemplary system for practicing the invention.

DETAILED DESCRIPTION OF THE PREFERRED EMBODIMENT(S)

Referring to the Drawing, an exemplary control system 10 for a four-cylinder, gasoline-powered engine 12 for a motor vehicle includes an electronic engine controller 14 having ROM, RAM and a processor ("CPU") as indicated, as well as an engine-off timer that provides a value for the elapsed time since the engine 12 was last turned off as a variable, "soak time." The controller 14 controls the operation of each of a set of fuel injectors 16. The fuel injectors 16, which are of conventional design, are each positioned to inject fuel into a respective cylinder 18 of the engine 12 in precise quantities as determined by the controller 14. The controller 14 similarly controls the individual operation, i.e., timing, of the current directed through each of a set of spark plugs 20 in a known manner.

The controller 14 also controls an electronic throttle 22 that regulates the mass flow of air into the engine 12. An air mass flow sensor 24, positioned at the air intake of engine's intake manifold 26, provides a signal regarding the air mass flow resulting from positioning of the engine's throttle 22. The air flow signal from the air mass flow sensor 24 is utilized by the controller 14 to calculate an air mass value AM which is indicative of a mass of air flowing per unit time into the engine's induction system.

A first oxygen sensor 28 coupled to the engine's exhaust manifold detects the oxygen content of the exhaust gas generated by the engine 12 and transmits a representative output signal to the controller 14. The first oxygen sensor 28 provides feedback to the controller 14 for improved control of the air-fuel ratio of the air-fuel mixture supplied to the engine 12, particularly during operation of the engine 12 at or near the stoichiometric air-fuel ratio ($\lambda$=1.00). A plurality of other sensors, including an engine speed sensor and an engine load sensor, indicated generally at 30, also generate additional signals in a known manner for use by the controller 14.

An exhaust system 32 transports exhaust gas produced from combustion of an air-fuel mixture in each cylinder 18 through a pair of emission control device 34,36, each of which functions in a known manner to reduce the amount of a selected constituent of the engine-generated exhaust gas, such as $NO_x$, exiting the vehicle tailpipe 38 during lean engine operation. A second oxygen sensor 40, which may also be a switching-type HEGO sensor, is positioned in the exhaust system 32 between the two emission control devices 34,36. A third oxygen sensor 42, which likewise is a switching-type HEGO sensor, is positioned downstream of the device 36. In accordance with another feature of the invention, a temperature sensor 43 generates a signal representing the instantaneous temperature T of the device 36, also useful in optimizing device performance as described more fully below.

Upon commencing lean engine operation, the controller 14 adjusts the output of the fuel injectors 16 to thereby achieve a lean air-fuel mixture for combustion within each cylinder 18 having an air-fuel ratio greater than about 1.3 times the stoichiometric air-fuel ratio. In accordance with the invention, for each subsequent background loop of the controller 14 during lean engine operation, the controller 14 determines a value representing the instantaneous rate FG_NOX_RATE at which $NO_x$ is being generated by the engine 12 as a function of instantaneous engine operating conditions, which may include, without limitation, engine speed, engine load, air-fuel ratio, EGR, and spark.

By way of example only, in a preferred embodiment, the controller 14 retrieves a stored estimate FG_NOX_RATE for the instantaneous $NO_x$-generation rate from a lookup table stored in ROM based upon sensed values for engine speed N and engine load LOAD, wherein the stored estimates FG_NOX_RATE are originally obtained from engine mapping data.

During a first engine operating condition, characterized by combustion in the engine 12 of a lean air-fuel mixture (e.g., $\lambda>1.3$), the controller 14 determines incremental or delta feedgas emissions from the engine, in grams/hr, generated since the last time through this loop, and preferably expressed by the following relationship:

$$FG_NOX_RATE=FNXXX1(N, LOAD)*FNXXA(\lambda)*FNXXB(EGRACT)*FNXXC(SPK_DELTA)*FMXXD(ECT\text{-}200)$$

where:

FNXXX1(N,LOAD) is a lookup table containing $NO_x$ emission rate values in gram/hr for current engine speed N and engine load LOAD;

FNXXA(λ) is a lookup table for adjusting the FG_NOX_RATE value for air-fuel which inherently adjusts the FG_NOX_RATE value for barometric pressure;

FNXXB(EGRACT) is a lookup table for adjusting the FG_NOX_RATE value for actual exhaust gas recirculation percentage;

FNXXC(SPK_DELTA) is a lookup table for adjusting the FG_NOX_RATE value for the effect of knock sensor or hot open-loop induced spark retard, with $NO_x$ production being reduced with greater spark retard; and FMXXD(ECT-200) is a lookup table for adjusting the FG_NOX_RATE value for the effect of engine coolant temperature above 200° F.

Preferably, the determined feedgas $NO_x$ rate FG_NOX_RATE is further modified to reflect any reduction in feedgas $NO_x$ concentration upon passage of the exhaust gas through the upstream emission control device 34, as through use of a ROM-based lookup table of three-way catalyst efficiency in reducing $NO_x$ as a function of the current air-fuel ratio λ, to obtain an adjusted instantaneous feedgas $NO_x$ rate ADJ_FG_NOX_RATE. The adjusted feedgas $NO_x$ rate is accumulated over the length of time $t_{i,j}$ that the engine 12 is operated within a given engine speed/load cell for which the feedgas $NO_x$ generation rate $R_{i,j}$ applies, which is typically assumed to be the duration of the control process's nominal background loop, to obtain a value representing an instantaneous amount ADJ_FG_NOX of feedgas $NO_x$ entering the device during the background loop.

Also during the lean operating condition, the controller 14 calculates an instantaneous value INCREMENTAL_NOX representing the incremental amount of $NO_x$ stored in the device 36 during each background loop executed by the controller 14 during a given lean operating condition, in accordance with the following formula:

$$INCREMENTAL_NOX=ADJ_FG_NOX_RATE*t_{i,j}*\mu,$$

where:

$\mu$ represents a set of adjustment factors for instantaneous device temperature T, open-loop accumulation of $SO_x$ in the device 36 (which, in a preferred embodiment, is itself generated as a function of fuel flow and device temperature T), desired device utilization percentage, and a current estimate of the cumulative amount of $NO_x$ which has already been stored in the device 36 during the given lean operating condition. The controller 14 thereafter calculates a value INST_TP_NOX based on the difference between the adjusted instantaneous feedgas $NO_x$ value ADJ_FG_NOX and the instantaneous value INCREMENTAL_NOX representing the incremental amount of $NO_x$ stored in the downstream emission control device 36. The controller 14 then compares the value INST_TP_NOX to a predetermined threshold level MAX_TP_NOX. If the controller 14 determines that the value INST_TP_NOX exceeds the predetermined threshold level MAX_TP_NOX, the controller 14 immediately discontinues the on-going lean engine operating condition in favor of either near-stoichiometric engine operating condition or a device-purging rich engine operating condition.

In accordance with another feature of the invention, an exemplary method includes generating a value representing a cumulative number of miles that the vehicle has traveled during a given device purge-fill cycle, i.e., since the commencement of an immediately prior device-purging rich engine operating condition; and determining a value representing average tailpipe $NO_x$. emissions in grams per mile using the third value and the accumulated mileage value. More specifically, when the system 10 is initially operated with a lean engine operating condition, the efficiency of the downstream device 36 is very high, and the tailpipe $NO_x$. emissions are correlatively very low. As the downstream device 36 fills, the efficiency of the downstream device 36 begins to fall, and the tailpipe $NO_x$ emissions value INST_TP_NOX will slowly rise up towards the threshold value MAX_TP_NOX. However, since the initial portion of the lean engine operating condition was characterized by very low tailpipe $NO_x$ emissions, the lean engine operating condition can be maintained for some time after the instantaneous value INST_TP_NOX exceeds the threshold value MAX_TP_NOX before average tailpipe $NO_x$ emissions exceed the threshold value MAX_TP_NOX. Moreover, since a purge event is likewise characterized by very low instantaneous tailpipe $NO_x$ emissions, average tailpipe $NO_x$. emissions are preferably calculated using a time period which is reset at the beginning of the immediately prior purge event.

To the extent that the calculated tailpipe $NO_x$. emissions does not exceed the predetermined threshold level, the controller 14 continues to track device fill time, as follows: the controller 14 iteratively updates a stored value TOTAL_NOX representing the cumulative amount of $NO_x$ which has been stored in the downstream device 44 during the given lean operating condition, in accordance with the following formula:

$$TOTAL_NOX\text{–}TOTAL_NOX+INCREMENTAL_NOX$$

The controller 14 further determines a suitable value NOX_CAP representing the instantaneous $NO_x$-storage capacity estimate for the device 36. By way of example only, in a preferred embodiment, the value NOX_CAP varies as a function of device temperature T, as further modified by an adaption factor $K_i$ periodically updated during fill-time optimization to reflect the impact of both temporary and permanent sulfur poisoning, device aging, and other device-deterioration effects.

The controller 14 then compares the updated value TOTAL_NOX representing the cumulative amount of $NO_x$ stored in the downstream device 36 with the determined value NOX_CAP representing the downstream device's instantaneous $NO_x$-storage capacity. The controller 14 discontinues the given lean operating condition and schedules a purge event when the updated value TOTAL_NOX exceeds the determined value NOX_CAP.

For example, in a preferred embodiment, if the controller 14 determines that the value INST_TP_NOX exceeds the predetermined threshold level MAX_TP_NOX, the controller 14 immediately schedules a purge event using an open-loop purge time based on the current value TOTAL_NOX representing the cumulative amount of $NO_x$ which has been stored in the device 44 during the preceding lean operating condition. In this regard, it is noted that the instantaneous device temperature T, along with the air-fuel ratio and air mass flow rate employed during the purge event, are preferably taken into account in determining a suitable open-loop purge time, i.e., a purge time that is sufficient to release substantially all of the $NO_x$ and oxygen previously stored in the downstream device 36.

As noted above, a temperature sensor directly measures the temperature T of the downstream device 36; however, it will be appreciated that device temperature may be inferred, for example, in the manner disclosed in U.S. Pat. No. 5,894,725 and U.S. Pat. No. 5,414,994, which disclosures are incorporated herein by reference.

If, at the end of the purge event, the controller 14 determines that the value INST_TP_NOX continues to exceed the predetermined threshold level MAX_TP_NOX, the controller 14 either selects a near-stoichiometric engine operating condition, or schedules another open-loop purge event.

Preferably, in accordance with another feature of the invention, the controller 14 initializes certain temperature and sulfur-accumulation variables in a manner to account for instances where an engine may be turned off for short periods of time in which the downstream device 36 may not have cooled to ambient temperature. More specifically, rather than resetting these variable to zero upon commencing lean engine operation, the controller 14 estimates these variables upon engine ignition as a function of respective values for the variables immediately preceding engine shutoff, ambient temperature, ambient humidity, and at least one respective calibratable time constant representing an amount of time for the variable to deteriorate to a value corresponding to the passage of a relatively large amount of time. Thus, for example, an initialization routine for a device temperature variable TEMP_INIT after a soak time SOAKTIME is preferably expressed as follows:

TEMP_INIT=((TEMP_PREVIOUS−AMBIENT)*FNEXP(−SOAKTIME/TEMP_TIME_CONST)

where:

TEMP_PREVIOUS is a value for device temperature T during the immediately preceding engine operating condition;

AMBIENT is a measured or inferred value representing current ambient temperature;

FNEXP is a lookup table value that approximates an exponential function;

SOAKTIME is the time elapsed since the engine was shut down, in seconds; and

TEMP_TIME_CONST is an empirically derived time constant associated with the cooling-off of the exhaust gas at an identified location on the downstream device 36, in seconds.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for controlling the operation of a lean-burn internal combustion engine, the exhaust gas from the engine being directed through an exhaust purification system including an emission control device that stores a constituent of the exhaust gas when the exhaust gas is lean of stoichiometry and that releases stored exhaust gas constituent when the exhaust gas is at or rich of stoichiometry, the method comprising:

determining, during a lean engine operating condition, a first value representing an incremental amount of the exhaust gas constituent generated by the engine;

determining a second value representing an incremental amount of the exhaust gas constituent being instantaneously stored in the device;

calculating a third value based on a difference between the first value and the second value;

averaging the third value over a first time period; and discontinuing the lean engine operating condition when the third value exceeds a predetermined threshold level.

2. The method of claim 1, wherein the first time period is a running time period, and including resetting the first time period to zero upon commencement of a rich engine operating condition immediately prior to the lean engine operating condition.

3. The method of claim 1, further including generating a fourth value representative of a cumulative number of miles that the vehicle has traveled during the first period, and determining a fifth value representing average tailpipe emissions of the exhaust gas constituent, in grams per mile, using the third value and the fifth value.

4. The method of claim 1, wherein the first value is determined as a function of at least one of the group consisting of engine speed, engine load, and air-fuel ratio.

5. The method of claim 1, further including:

calculating a sixth value representing the cumulative amount of the exhaust gas constituent stored in the device during a lean operating condition based on the second value; and determining a seventh value representing an instantaneous constituent-storage capacity for the device, and wherein discontinuing includes comparing the sixth value to the seventh value.

6. The method of claim 5, wherein calculating the sixth value includes determining an eighth value representing an amount of sulfur accumulated in the device.

7. A system for controlling the operation of a lean-burn internal combustion engine, the exhaust gas from the engine being directed through an exhaust purification system including an emission control device that stores a constituent gas of the exhaust gas when the exhaust gas is lean of stoichiometry and that releases stored exhaust gas constituent when the exhaust gas is at or rich of stoichiometry, the system comprising:

a controller including a microprocessor arranged to determine, during a lean engine operating condition, a first value representing an incremental amount of the exhaust gas constituent generated by the engine and a second value representing an incremental amount of the exhaust gas constituent being instantaneously stored in the device, wherein the controller is further arranged to calculate a third value based on a difference between the first value and the second value, to average the third value over a first time period, and to discontinue the lean engine operating condition when the third value exceeds a predetermined threshold level.

8. The system of claim 7, wherein the first time period is a running time period, and the controller is further arranged to reset the first time period to zero upon commencement of a rich engine operating condition immediately prior to the lean engine operating condition.

9. The system of claim 7, wherein the controller is further arranged to generate a fourth value representing a cumulative number of miles that the vehicle has traveled during the first period, and to determine a fifth value representing average tailpipe emissions of the exhaust gas constituent, in grams per mile, using the third value and the fifth value.

10. The system of claim 7, wherein the controller is further arranged to determine the first value as a function of at least one of the group consisting of engine speed, engine load, and air-fuel ratio.

11. The system of claim 7, wherein the controller is further arranged to calculate a sixth value representing the cumulative amount of the exhaust gas constituent stored in the device during a lean operating condition based on the second value, to determine a seventh value representing an instantaneous constituent-storage capacity for the device, and to compare the sixth value to the seventh value.

12. The system of claim 11, wherein the controller is further arranged to determine an eighth value representing an amount of sulfur accumulated in the device when determining the sixth value.

* * * * *